US010434557B2

(12) United States Patent
Polo et al.

(10) Patent No.: US 10,434,557 B2
(45) Date of Patent: Oct. 8, 2019

(54) METHOD FOR HOT FORMING SHEETS HAVING ARCUATE SHAPES

(71) Applicants: Michael G. Polo, Wethersfield, CT (US); Anthony M. Cacace, Haddam, CT (US); Carl M. Johnson, Manchester, CT (US)

(72) Inventors: Michael G. Polo, Wethersfield, CT (US); Anthony M. Cacace, Haddam, CT (US); Carl M. Johnson, Manchester, CT (US)

( * ) Notice: Subject to any disclaimer, the term of this patent is extended or adjusted under 35 U.S.C. 154(b) by 110 days.

(21) Appl. No.: 15/372,952

(22) Filed: Dec. 8, 2016

(65) Prior Publication Data

US 2017/0182538 A1 Jun. 29, 2017

Related U.S. Application Data

(60) Provisional application No. 62/264,610, filed on Dec. 8, 2015.

(51) Int. Cl.
*B21D 22/02* (2006.01)
*B21D 7/16* (2006.01)

(52) U.S. Cl.
CPC ..... *B21D 22/022* (2013.01); *B21D 7/16* (2013.01)

(58) Field of Classification Search
CPC ..... B21D 7/16; B21D 7/162; B21D 22/022; B21D 22/02; B30B 15/34
See application file for complete search history.

(56) References Cited

U.S. PATENT DOCUMENTS

| | | | |
|---|---|---|---|
| 3,238,034 | A | 3/1966 | Jendrisak |
| 3,915,742 | A | 10/1975 | Battles et al. |
| 4,812,157 | A | 3/1989 | Smith |
| 6,463,779 | B1 | 10/2002 | Terziakin |
| 6,578,385 | B1 | 6/2003 | Tamai et al. |
| 7,284,402 | B2 | 10/2007 | Friedman et al. |

(Continued)

FOREIGN PATENT DOCUMENTS

| | | | | |
|---|---|---|---|---|
| DE | 102011120725 | A1 * | 6/2012 | ..... B21D 22/022 |
| EP | 2633942 | A2 | 9/2013 | |

OTHER PUBLICATIONS

EPO translation of DE 102011120725; Aug. 2018.*

(Continued)

*Primary Examiner* — Pradeep C Battula
(74) *Attorney, Agent, or Firm* — MKG, LLC

(57) ABSTRACT

A method is presented for hot forming sheets having arcuate shapes. The method includes providing a die having a first and second clamping section. The first clamping section has a first arcuate pressing surface and the second clamping section has a complementary second arcuate pressing surface. The clamping sections have a plurality of heaters disposed therein. The die is heated to a predetermined temperature. The clamping sections are spaced apart by a predetermined distance. A precursor sheet is positioned therebetween such that the precursor sheet is spaced apart from the first arcuate pressing surface by a spacing distance. The clamping sections are pressed into engagement with the precursor sheet to form a production sheet having a predetermined shape by engagement with the first pressing surface and the second pressing surface and a predetermined pressing force for a predetermined pressing time.

13 Claims, 7 Drawing Sheets

(56) References Cited

U.S. PATENT DOCUMENTS

| | | | | |
|---|---|---|---|---|
| 8,845,945 | B2 | 9/2014 | Parkin | |
| 2002/0062941 | A1 | 5/2002 | Cowie et al. | |
| 2012/0111078 | A1 | 5/2012 | Morales | |
| 2013/0195674 | A1 | 8/2013 | Watson et al. | |
| 2014/0202345 | A1* | 7/2014 | Wood | B30B 15/34 100/315 |
| 2015/0013144 | A1 | 1/2015 | Bush et al. | |
| 2016/0108505 | A1 | 4/2016 | Fujii et al. | |

OTHER PUBLICATIONS

Non-Final Office Action issued in U.S. Appl. No. 15/075,795, dated Dec. 4, 2018.

European Search Report issued in European Patent Application No. 17162173.3, dated Nov. 27, 2017.

Altan, et al. "Cold and Hot Forging—Fundamentals and Applications"; ASM International; 2004.

* cited by examiner

METHOD FOR HOT FORMING SHEETS HAVING ARCUATE SHAPES

CROSS-REFERENCE TO RELATED APPLICATION

This application claims the benefit, in accordance with 35 U.S.C. § 119(e), of U.S. Provisional Patent Application Ser. No. 62/264,610; filed on Dec. 8, 2015, which is incorporated herein by reference in its entirety.

TECHNICAL FIELD

The present invention is directed to a method for hot forming sheets having complex three dimensional shapes, and more particularly for hot forming aluminum alloy sheets having complex three dimensional shapes for use in fan blade covers for use in gas turbine engines for aircraft applications.

BACKGROUND

Sheets having a complex shape have numerous uses in many fields. For example, turbines (such as those of, e.g., a jet engine) generally employ one or more such sheets for various purposes, e.g., to generate thrust. It is required of sheets having a complex shape that the sheets be manufactured precisely, accurately, and with uniformity, at least in order to ensure predictability in the sheet's application. However, due to practical aspects intrinsic in manufacturing processes of the prior art, it is difficult to manufacture sheets having complex shapes with the requisite precision, accuracy, and uniformity.

There is an unfulfilled need for a process of forming sheets having complex shapes that routinely results in sheets that are uniform relative to one another, and are precisely and accurately formed.

SUMMARY OF THE INVENTION

In one aspect, the present invention is directed to a method for hot forming sheets having complex shapes, the method comprising: providing a die having a first clamping section and a second clamping section, the first clamping section defining a first arcuate pressing surface and the second clamping section defining a second arcuate pressing surface complementary to the first pressing surface, and the first clamping section and the second clamping section each having a plurality of heaters disposed therein; providing a precursor sheet; in the following order: heating the die with the plurality of heaters to a predetermined temperature; spacing the first clamping section apart from the second clamping section by a predetermined distance; positioning the precursor sheet between the first clamping section and the second clamping section such that the precursor sheet is spaced apart from the first arcuate pressing surface by a spacing distance; closing the first clamping section and the second clamping section toward one another and into engagement with the precursor sheet; and pressing the precursor sheet into a production sheet having a predetermined shape by engagement with the first pressing surface and the second pressing surface via a predetermined pressing force for a predetermined pressing time.

In another aspect, the present invention is directed to a program for hot forming sheets having complex shapes, the program stored on a non-transitory computer readable medium that causes a processor to execute: heating a plurality of heaters embedded within a die having a first clamping section and a second clamping section, the first clamping section defining a first arcuate pressing surface and the second clamping section defining a second arcuate pressing surface complementary to the first pressing surface; spacing the first clamping section apart from the second clamping section by a predetermined distance; positioning a precursor sheet between the first clamping section and the second clamping section such that the precursor sheet is spaced apart from the first arcuate pressing surface by a spacing distance; closing the first clamping section and the second clamping section toward one another and into engagement with the precursor sheet; and pressing the precursor sheet into a production sheet having a predetermined shape by engagement with the first pressing surface and the second pressing surface via a predetermined pressing force for a predetermined pressing time.

DETAILED DESCRIPTION

Figure 1:
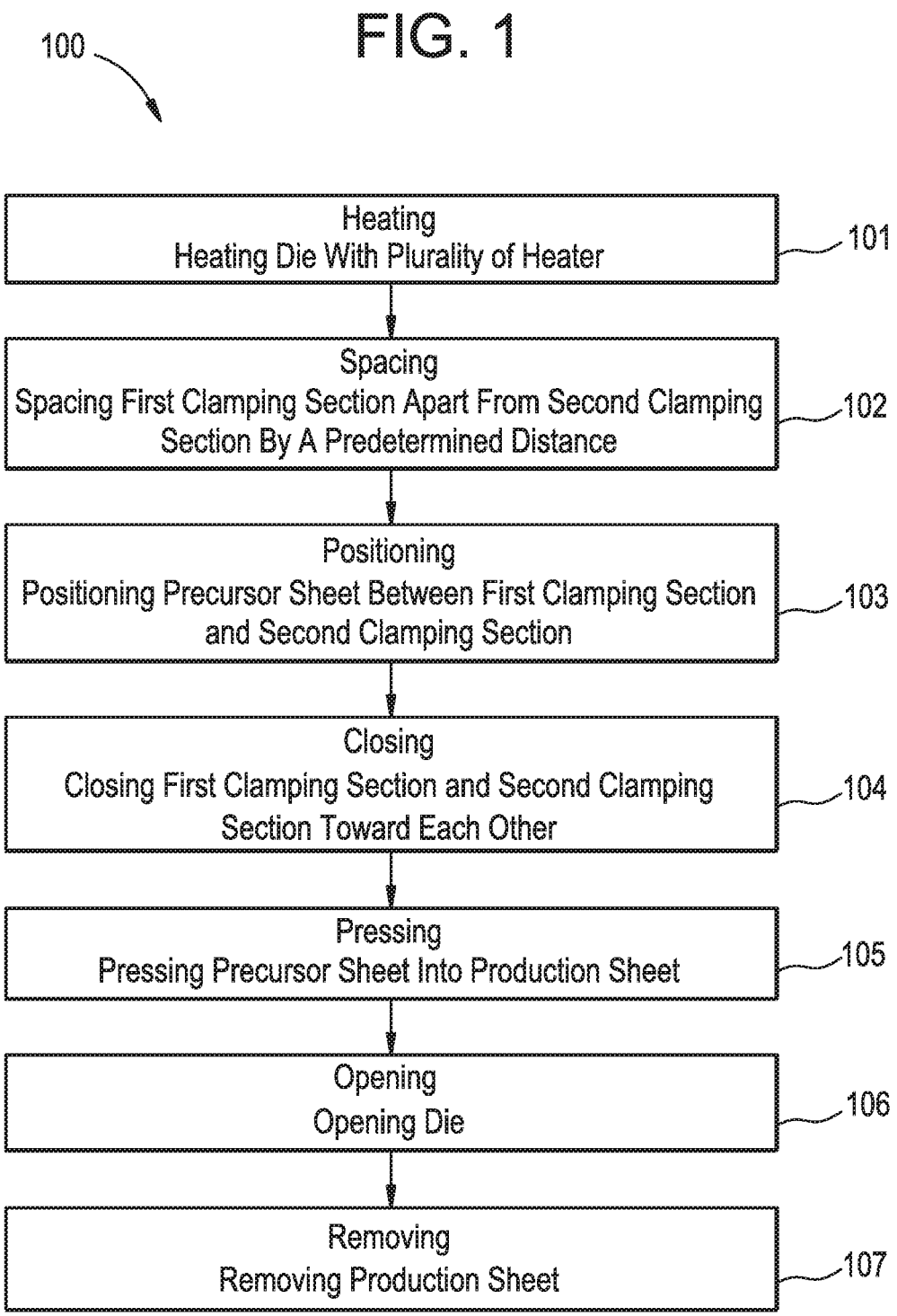
FIG. 1 is a flow chart illustrating the method for hot forming of the present invention.

As shown in FIG. 1, a method of forming sheets having complex shapes, such as for example three dimensional shapes, hereinafter referred to as the method 100 includes the steps of heating 101; spacing 102; positioning 103; closing 104; pressing 105; opening 106; and removing 107. Heating step 101 includes heating a die with one or more heaters or heating elements. Spacing step 102 includes spacing a first clamping section of the die apart from a second clamping section of the die by a predetermined distance. Positioning step 103 includes positioning a precursor sheet between the first clamping section and the second clamping section. Closing step 104 includes closing the spacing between the first clamping section and the second clamping section thereby closing the die. Pressing step 105 includes pressing the precursor sheet positioned in the die into a productions sheet. Opening step 106 includes opening the die thereby separating the first clamping section from the second clamping section. Removing step 107 includes removing the production sheet from the die. Method 100 and the named components thereof are described in detail below with respect to FIGS. 4 and 5.

Figure 2:
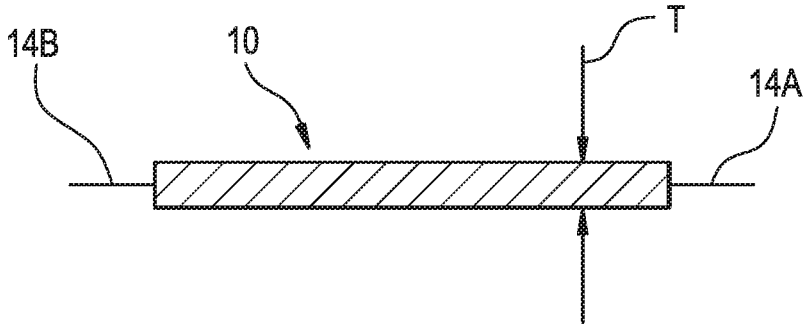
FIG. 2 is a cross sectional view of a precursor sheet of the present invention.
Figure 3:
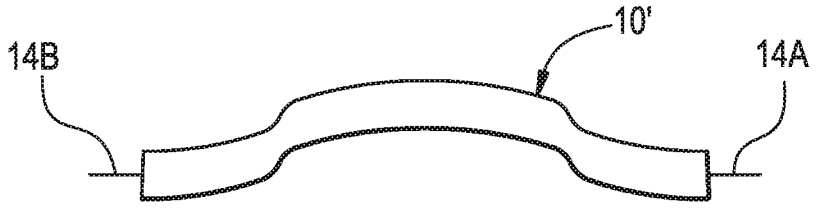
FIG. 3 is a cross sectional view of a production sheet of the present invention.
Figure 4:
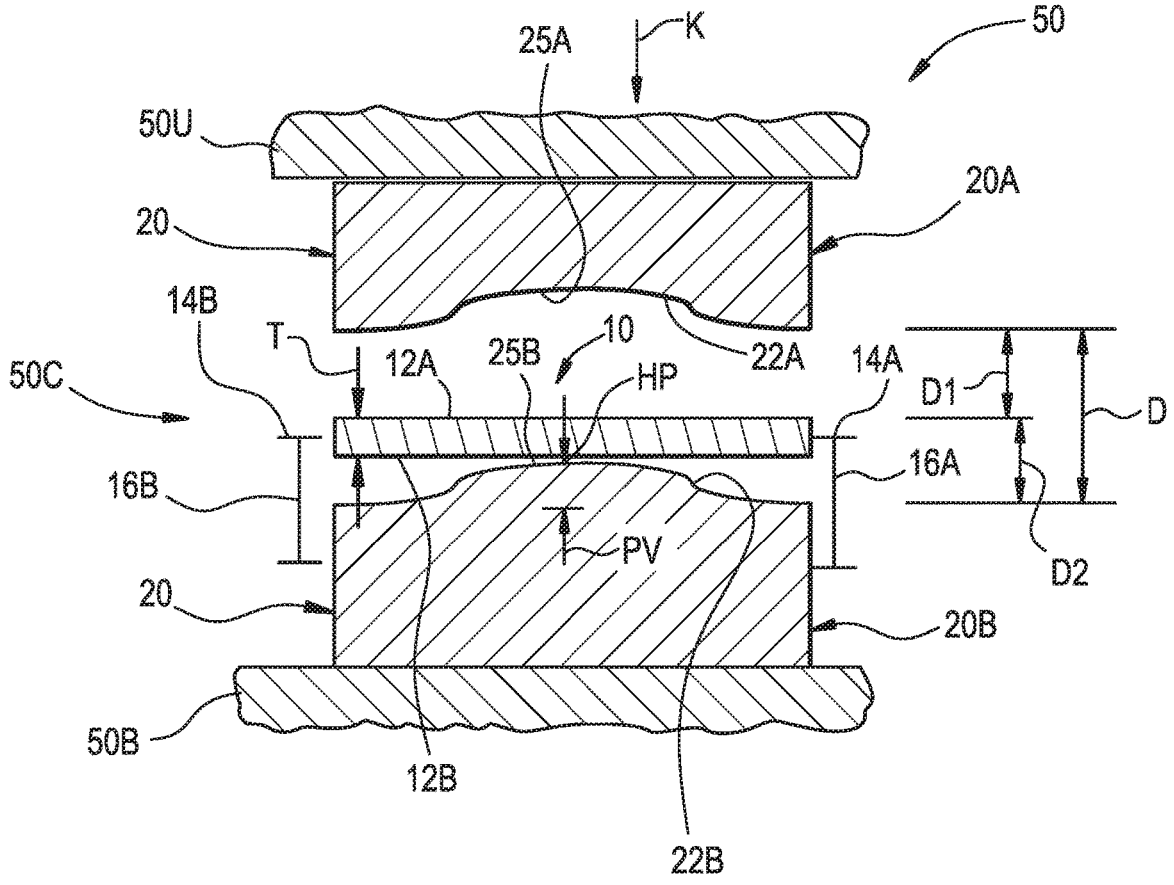
FIG. 4 is a cross sectional view of the precursor sheet of FIG. 2 relative to a die of the present invention, wherein the die is in an opened position.
Figure 5:
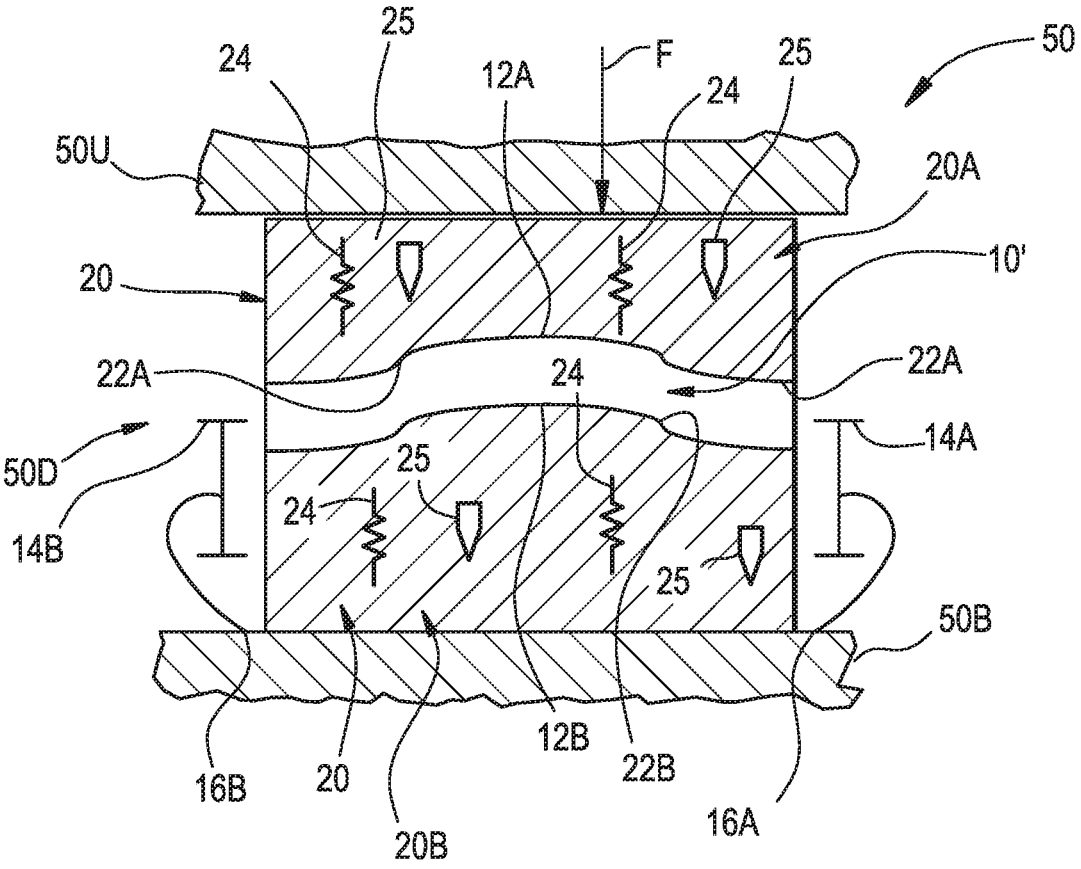
FIG. 5 is a cross sectional view of the production sheet of FIG. 3 relative to the die of the present invention, wherein the die is in a closed position.

As can be seen in FIGS. 4 and 5, a precursor sheet 10 and a die 20 are provided for use in the method 100. As shown in FIGS. 2 and 4, the precursor sheet 10 has a flat surface on opposing sides, and is, generally, of uniform thickness T (e.g., 1 mm or 0.04 inches) throughout. However, one skilled in the art would understand that other suitable surface shapes and/or thicknesses may be employed to the same effect, and, thus, that other such other shapes and thicknesses can be employed (e.g., arcuate surfaces; non-uniform thicknesses). Additionally, in the embodiment shown in FIGS. 2-5, the precursor sheet 10 includes mounting fixtures 14A and 14B (e.g., tabs with holes therein extending from the precursor sheet 10) on opposing axial ends of the precursor sheet 10. However, any suitable number of mounting fixtures 14A and 14B may be employed to the same effect, such as, e.g., one mounting fixture; or three, four, or more mounting fixtures. In one embodiment, the precursor sheet 10 includes an aluminum alloy, although any suitable alloy(s) may be employed to the same effect, either alternatively to or in combination with an aluminum alloy.

As can further be seen in FIGS. 4 and 5, the die 20 includes a first clamping section 20A and a second clamping section 20B. The die 20 may be placed in an open position 50C as shown in FIG. 4 wherein the first clamping section 20A is spaced apart from the second clamping section 20B; and in a closed position 50D as shown in FIG. 5 wherein the first clamping section 20A and the second clamping section 20B abut the precursor sheet 10 positioned therebetween. The first clamping section 20A is secured to a movable section 50U (e.g., upper section) of a press 50. The second clamping section 20B is secured to a fixed base portion 50B of the press 50. The moveable section 50 U of the press 50 and the first clamping section 20A of the die 20 are moveable in the direction of the arrow K as shown in FIG. 4 via a suitable control system and actuator (e.g., hydraulic press actuator). The first clamping section 20A includes a first arcuate pressing surface 22A. A central portion of the first arcuate pressing surface 22A includes a concave area 25A. The second clamping section 20B includes a second arcuate pressing surface 22B. A central portion of the second arcuate pressing surface 22B includes a convex area 25B having a high point HP.

In one embodiment, the die 20 includes two mounting members 16A and 16B (e.g., tapered pins) extending axially therefrom that are configured to receive the mounting fixtures 14A and 14B of the precursor sheet 10 to position the precursor sheet 10 in a standby position between the first clamping section 20A and the second clamping section 20B. In one embodiment, the mounting members 16A and 16B are secured to the second clamping section 20B. In one embodiment, the mounting members 16A and 16B are secured to the first clamping section 20A. In one embodiment, the mounting members 16A and 16B are secured another fixture (not shown).

In one embodiment, the die 20 includes one or more heating elements or heaters 24 embedded therein. In one embodiment, each of the first clamping section 20A and the second clamping section 20B include includes one or more heating element or heater 24 embedded therein. In one embodiment, the die 20 includes one or more temperature sensors or thermocouples 25 embedded therein. In one embodiment, each of the first clamping section 20A and the second clamping section 20B include includes one or more temperature sensors or thermocouples 25 embedded therein.

The high point HP of the second clamping section 20B is adapted to support the precursor sheet 10 on a common plane defined by the precursor sheet 10, the high point HP and engagement areas between the mounting fixtures 14A and 14B of the precursor sheet 10 and the mounting members 16A and 16B secured to the second clamping section 20B. The first arcuate pressing surface 22A and the second arcuate pressing surface 22B are configured to engage the precursor sheet 10 such that the shape of the precursor sheet 10 acquires the desired complex shape via the method 100 disclosed herein. For example, as shown in FIGS. 4 and 5, the first arcuate pressing surface 22A and the second arcuate pressing surface 22B are complementary. The present invention is not limited in this regard, however, as any suitable contour(s) may be employed on the first pressing surface 22A and/or the second pressing surface 22B to the same effect.

The heating step 101 includes heating the die 20 from ambient temperature to a predetermined temperature. As used herein, the term "ambient temperature" refers, generally, to the temperature of the precursor sheet 10 prior to the heating step 101. The heating step 101 is generally accomplished within a predetermined heating time suitable to have the first clamping section 20A and the second clamping section 20B reach a predetermined temperature uniformly therethrough. In one embodiment, the predetermined temperature is 440.5 degrees Centigrade (825 degrees Fahrenheit). The heating step 101 is generally performed with the first clamping section 20A and the second clamping section 20B in a closed position to reduce heat losses. After the die 20 is heated to the predetermined temperature, the die 20 is opened so that the first clamping section 20A and the second clamping section 20B are spaced apart from one another as described herein.

The spacing step 102 includes spacing the first clamping section 20A apart from the second clamping section 20B at a predetermined distance D (see FIG. 4). In one embodiment, the predetermined distance D is between about 150 mm and 300 mm (between about 6 and 12 inches). In one embodiment, the predetermined distance D is equal to a peak to valley depth profile distance PV of the die 20 (as shown in FIG. 4) plus the thickness T of the precursor sheet 20 (the sum of which is referred to herein as a second spacing distance D2 as shown on FIG. 4) plus a first spacing distance D1 suitable to permit the precursor sheet 10 to be positioned in the die 20 and mounted on the mounting members 16A and 16B. In one embodiment, the predetermined distance D is configured to facilitate positioning of the precursor sheet 10 between the first clamping section 20A and the second clamping section 20B.

The positioning step 103 includes positioning the precursor sheet 10 between the first clamping section 20A and the second clamping section 20B when the die 20 is in the open position 50C, as shown in FIG. 4. In one embodiment, the positioning step 103 further includes engaging the mounting fixtures 14A and 14B with mounting members 16A and 16B and the high point HP. In one embodiment when the die 20 is in the open position 50C, a first precursor sheet surface 12A of the precursor sheet 10 is spaced apart from the first arcuate pressing surface 22A by the first spacing distance D1. In one embodiment, the first spacing distance D1 is determined to allow suitable clearance for positioning the precursor sheet 10 between the first clamping section 20A and the second clamping section 20B.

The closing step 104 includes moving the first clamping section 20A in the direction of the arrow K toward the second clamping section 20B so that the precursor sheet 10 conforms to the arcuate surfaces of the first pressing surface 22A and the second pressing surface 22B, as shown in FIG. 5. Specifically, the predetermined distance D is reduced until a majority of the first precursor sheet surface 12A is in contact with a majority of the first pressing surface 22A and a majority of the second precursor sheet surface 12B is in contact with a majority of the second pressing surface 22B such that the predetermined distance D is about equal to the thickness T. As used herein, the term "majority" means 50% or more, with preference for higher percentage, but in view of practical limitations of the precursor sheet 10 (e.g., size, alloy properties, etc.). In one embodiment, 75% of the first precursor sheet surface 12A is in contact with the first pressing surface 22A and 75% of the second precursor sheet surface 12B is in contact with the second pressing surface 22B. The closing step 104 is completed within a predetermined closing time. In one embodiment, the closing time is 2 minutes. However, the predetermined closing time is not limited in this regard, as any suitable predetermined closing time may be employed to the same effect. During the closing step 104, the first clamping section 20A and the second clamping section 20B are maintained at the predetermined temperature, for example, 440.5 degrees Centigrade (825 degrees Fahrenheit).

Figure 6:
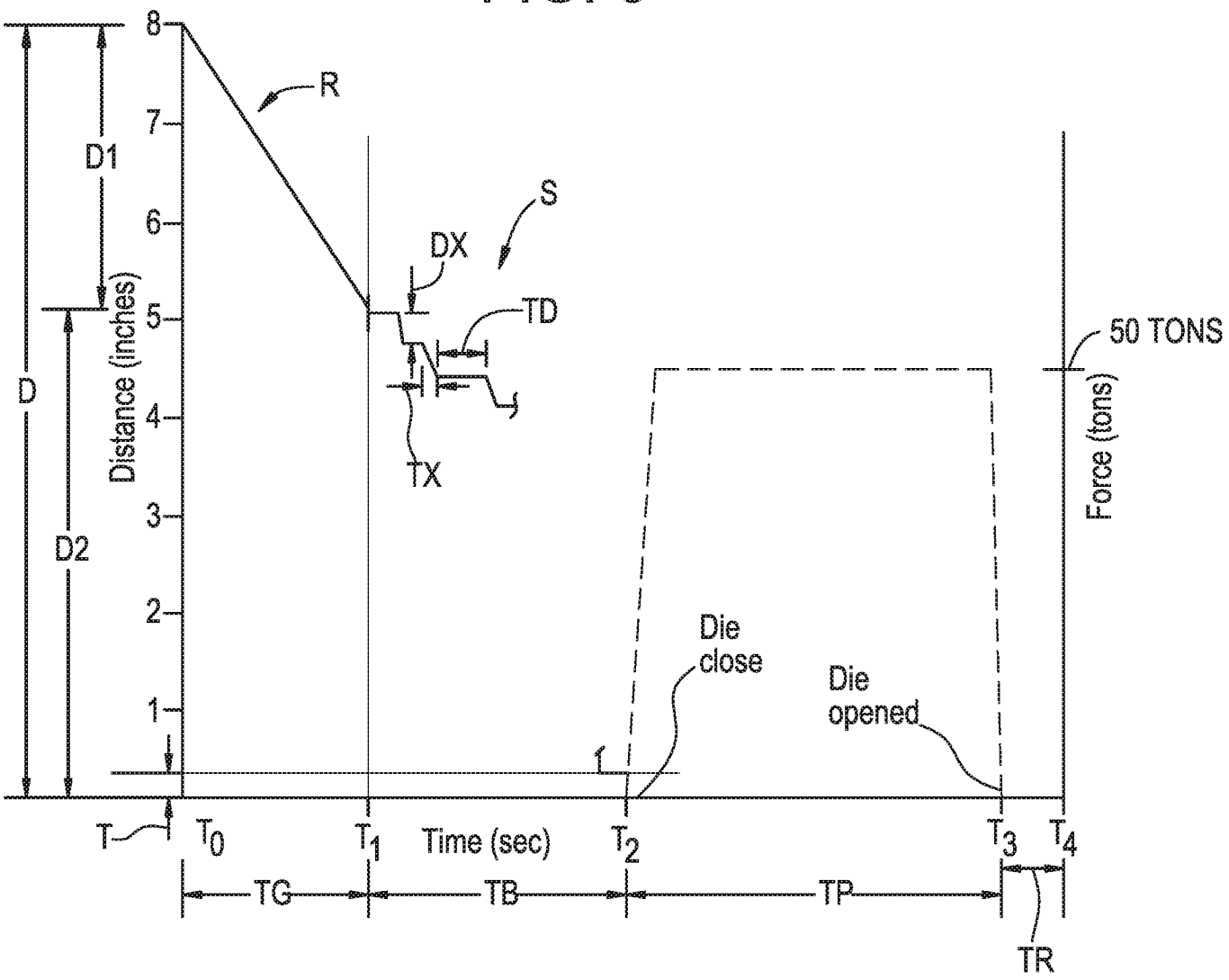
FIG. 6 is a histogram of the closure operation of the die of FIG. 4.

As shown in FIG. 6, in one embodiment, the closing step 104 includes an initial ramp section R followed by a stepped section S. During the ramp section R, the first clamping section 20A is moved toward the second clamping section 20B at a constant rate over the first spacing distance D1 during a time TG (T0–T1) until the first clamping section 20A first makes contact with the precursor sheet 10. After the first clamping section 20A first makes contact with the precursor sheet 10, the stepped section S is initiated, wherein the first clamping section 20A is moved toward the second clamping section 20B in a predetermined number of incremental steps of incremental closing distances DX during a respective time increment TX to allow uniform bending and forming of the precursor sheet 10. The stepped section S includes incremental dwell times TD between successive steps of incremental closing distances DX. During the dwell times TD, the first clamping section 20A is stopped to allow uniform heating of the precursor sheet 10. In one embodiment, between 60 and 70 incremental steps are employed, although only two steps are shown in FIG. 6 for simplicity of drafting the figure. In one embodiment, the incremental distances DX are each between about 1.25 mm and 3.85 mm (between about 0.05 and 0.15 inches). In one embodiment, the time increments TX are about 0.5 seconds plus or minus 0.25 seconds. In one embodiment, the dwell times TD are between about 1 and 2 seconds. In one embodiment, the dwell times TD are determined based on a temperature profile of the precursor sheet 10. In one embodiment, the entire step section S is accomplished in between 1.5 and 2.5 minutes. In one embodiment, the precursor sheet 10 is formed and pressed radially outward and over the convex area 25B to prevent wrinkles in the precursor sheet 10. As shown in FIG. 6, after the die 20 is closed at a time T2, the pressing step 105 is initiated as described herein.

The pressing step 105 includes pressing the precursor sheet 10 (FIG. 2) into a production sheet 10' (FIG. 3) having a predetermined shape. The first pressing surface 22A and the second pressing surface 22B engage the precursor sheet 10 via a predetermined pressing force F for a predetermined pressing time TP, as shown in FIG. 6. As used herein regarding the first pressing surface 22A relative to the second pressing surface 22B, the term "engaged" means that the predetermined force F is applied to the first pressing surface 22A, the second pressing surface 22B, or both, so as to induce conformation of the precursor sheet 10 to the production sheet 10'. During the pressing step 105, the first clamping section 20A and the second clamping section 20B are maintained at the predetermined temperature, for example, 440.5 degrees Centigrade (825 degrees Fahrenheit). In one embodiment, the predetermined pressing time TP is 5 minutes. In one embodiment, the predetermined pressing time TP ranges from 4.5 minutes to 5.5 minutes. In one embodiment, the predetermined pressing time TP ranges from 4.75 minutes to 5.25 minutes. In one embodiment, the predetermined pressing force F is at least 50 tons. As a result of the pressing, at least 99% of the first precursor sheet surface 12A is in contact with the first pressing surface 22A and at least 99% of the second precursor sheet surface 12B is in contact with a the second pressing surface 22B.

The opening step 106 includes opening the die 20. The first clamping section 20A and the second clamping section 20B are separated. The opening step 106 is commenced only after the pressing step 105 is complete. The production sheet 10' remains suspended by the mounting fixtures 14A and 14B.

The removing step 107 includes removing the production sheet 10' from the die 20. For example, the mounting fixtures 14A and 14B are disengaged from the mounting members 16A and 16B.

In one embodiment, the method 100 further includes the step of positioning the production sheet 10' for cooling after the removing step 107.

In one embodiment, the method 100 further includes the step of removing the mounting fixtures 14A and 14B from the production sheet 10'.

In one embodiment, the method 100 further includes the step of providing a plurality of the temperature sensors 25 in each of the first clamping section 20A and the second clamping section 20B (e.g., 14 temperature sensors such as thermocouples in each of the first clamping section 20A and the second clamping section 20B). In one embodiment, the method 100 further includes the step of providing a plurality of the heaters 24 (e.g., 5 Cal. rods) in each of first clamping section 20A and the second clamping section 20B.

Figure 7:
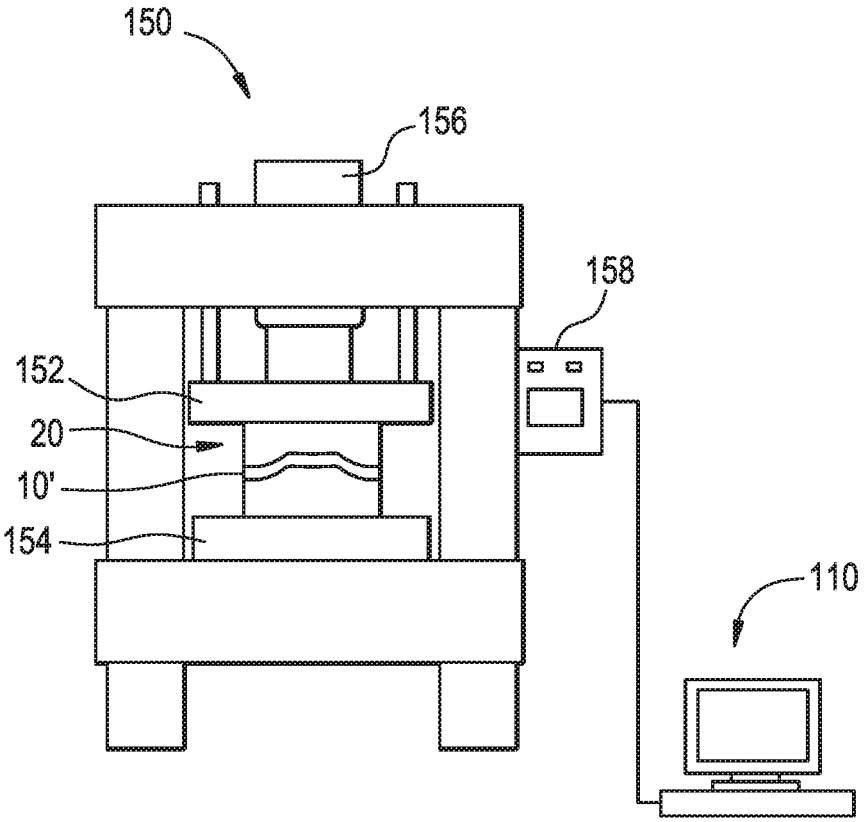
FIG. 7 is a front perspective view of a press for performing the method for hot forming of FIG. 1.

In one embodiment of the method 100, and as shown in FIG. 7, a press 150, for example a hydraulic press, is employed to selectively control and operate control the die 20 to form the production sheet 10'. The press 150 includes a top tool 152 and a bottom tool 154 between which the die 20 is positioned. The pressing step 105 described above includes engaging the press drive 156 thereby pressing the precursor sheet 10 into the production sheet 10' having the predetermined shape. In one embodiment, the press 150 is configured and selectively performs the method 100 by use of a controller 158 operatively coupled to the press 150, such as for example, a computer numerical controller.

Figure 8:
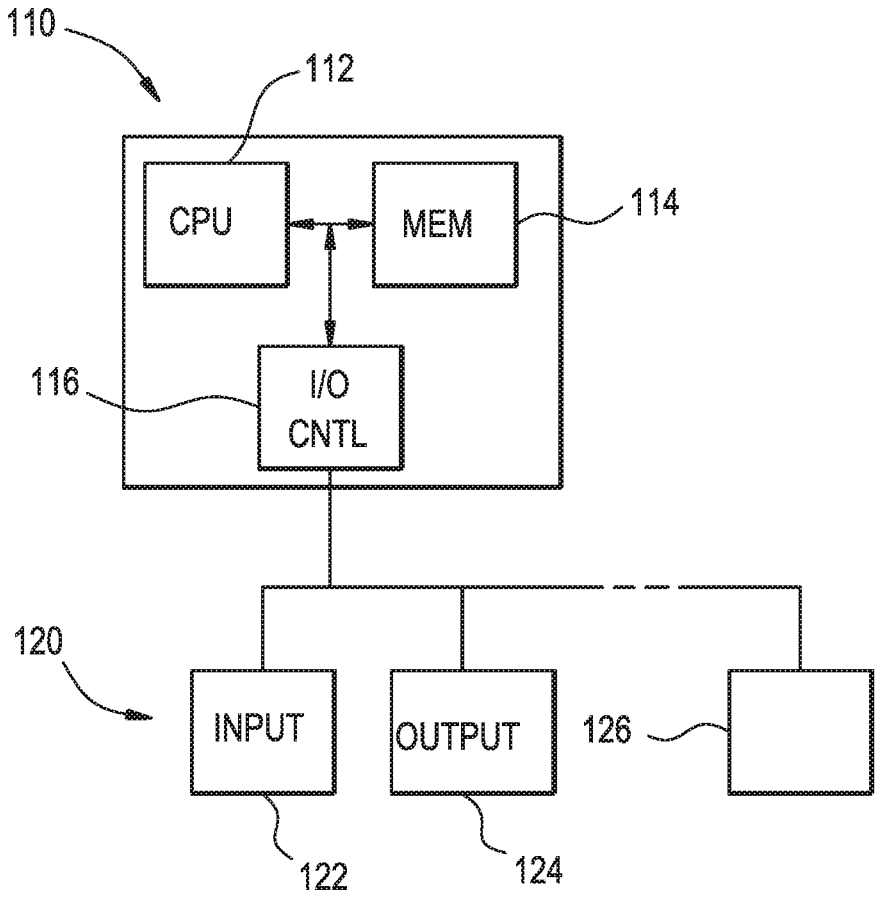
FIG. 8 is a simplified schematic block diagram of an exemplary computing system for use with in the method for hot forming of the present invention.

In one embodiment of the method 100, and as shown in FIGS. 7 and 8, a computer system 110 is configured to control and selectively operates the press 150, and in turn the die 20, to form the production sheet 10'. The computer system 110 is, for example, a desktop computer, tablet computer, laptop computer, or other computing device that includes a processor such as a microprocessor or CPU 112, a non-transitory computer-readable medium or memory 114, an input-output controller 116 operatively coupled to input and output devices, respectively shown generally at 120, including one or more input devices 122 for facilitating transmission or input of data and information to the system 110 such as a keyboard, a mouse, a light pen pointing device, document scanner, or other input device, and one or more output devices 124 for facilitating transmission or output of data and information from the system 110 such as a display device, printer, or machine numerical control device 126 or the like, or the controller 158 operatively coupled to the press 150. In one embodiment, the input device 122 and the output device 124 are embodied as a unitary device, for example, the controller 158 operatively coupled to the press 150. The processor 112 executes computer-implemented steps for running a software application program for operating the press 150 with the control device 126 or the controller 158 to perform the method 100.

In one embodiment, the method 100 further includes the step of placing the plurality of temperature sensors 25 in communication with the control device 126 or the controller 158 for sending and receiving, or transmitting, data to the control device 126 or the controller 158. In one embodiment, the method 100 further includes the step of placing the plurality of heaters 24 in communication with the control device 126 or the controller 158 for sending and receiving, or transmitting, data to the control device 126 or the controller 158. In one embodiment, the method 100 further includes the step of controlling, with the control device 126 or the controller 158, the operation of the heaters to maintain a predetermined temperature profile in the first clamping section 20A and a second clamping section 20B.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A method for hot forming sheets having arcuate shapes, the method comprising:
- providing a die having a first clamping section and a second clamping section, the first clamping section defining a first arcuate pressing surface and the second clamping section defining a second arcuate pressing surface complementary to the first pressing surface, and the first clamping section and the second clamping section each having a plurality of heaters disposed therein;
- providing a precursor sheet;
- in the following order:
  - heating the die with the plurality of heaters to a predetermined temperature;
  - spacing the first clamping section apart from the second clamping section by a predetermined distance;
  - positioning the precursor sheet between the first clamping section and the second clamping section such that the precursor sheet is spaced apart from the first arcuate pressing surface by a spacing distance;
  - closing the first clamping section and the second clamping section toward one another and into engagement with the precursor sheet, wherein the closing of the first clamping section is accomplished in a predetermined number of incremental steps; and
  - pressing the precursor sheet into a production sheet having a predetermined shape by engagement with the first pressing surface and the second pressing surface via a predetermined pressing force for a predetermined pressing time.

2. The method of claim 1, further comprising:
- removing the production sheet from the die; and
- positioning the production sheet for cooling.

3. The method of claim 1, wherein the predetermined pressing time is 5 minutes.

4. The method of claim 3, wherein the method further comprises opening the die upon completion of the 5 minutes of pressing.

5. The method of claim 1, wherein the predetermined pressing force is at least 50 tons.

6. The method of claim 1, wherein the predetermined pressing time ranges from 4.5 minutes to 5.5 minutes.

7. The method of claim 1, wherein the predetermined pressing time ranges from 4.75 minutes to 5.25 minutes.

8. The method of claim 1, wherein the method further comprises:
- providing a plurality of temperature sensors in each of the first clamping section and the second clamping section;
- providing a computer processor in communication with the plurality of temperature sensors;
- providing at least one controller in communication with the computer processor and one or more of the plurality of heaters; and
- controlling with the computer processor the operation of the heaters to maintain a predetermined temperature profile in the first clamping section and the second clamping section.

9. The method of claim 1, wherein the precursor sheet is flat.

10. The method of claim 1, wherein the precursor sheet comprises an aluminum alloy.

11. The method of claim 1, wherein the predetermined temperature is 440.5 degrees Centigrade (825 degrees Fahrenheit).

12. A method for hot forming sheets having arcuate shapes, the method comprising:
- providing a die having a first clamping section and a second clamping section, the first clamping section defining a first arcuate pressing surface and the second clamping section defining a second arcuate pressing surface complementary to the first pressing surface, and the first clamping section and the second clamping section each having a plurality of heaters disposed therein;
- providing a precursor sheet;
- providing one or more mounting fixtures extending axially from the precursor sheet;
- in the following order:
  - heating the die with the plurality of heaters to a predetermined temperature;
  - spacing the first clamping section apart from the second clamping section by a predetermined distance;
  - positioning the precursor sheet between the first clamping section and the second clamping section such that the precursor sheet is spaced apart from the first arcuate pressing surface by a spacing distance;
  - closing the first clamping section and the second clamping section toward one another and into engagement with the precursor sheet;
  - pressing the precursor sheet into a production sheet having a predetermined shape by engagement with the first pressing surface and the second pressing surface via a predetermined pressing force for a predetermined pressing time; and
- removing the mounting fixtures from the production sheet.

13. The method of claim 12, wherein the method further comprises providing one or more mounting members extending axially from the die and configured to engage the one or more mounting fixtures.

* * * * *